United States Patent [19]

Nakako et al.

[11] Patent Number: 4,796,797

[45] Date of Patent: Jan. 10, 1989

[54] METHOD FOR MAKING THIN-WALLED METAL PIPES

[75] Inventors: Takefumi Nakako; Shoji Inoue; Akinobu Takezoe, all of Sakai, Japan

[73] Assignee: Nisshin Steel Co., Ltd., Tokyo, Japan

[21] Appl. No.: 84,431

[22] Filed: Aug. 12, 1987

[30] Foreign Application Priority Data

Oct. 14, 1986 [JP] Japan ..... 61-243854

[51] Int. Cl.[4] ..... B23K 31/06

[52] U.S. Cl. ..... 228/144; 72/52; 72/168; 72/177

[58] Field of Search ..... 72/52, 168, 171, 177, 72/181; 228/143, 144, 17.5, 173.4

[56] References Cited

U.S. PATENT DOCUMENTS

| | | | |
|---|---|---|---|
| 2,854,056 | 9/1958 | Stanius | 62/168 |
| 3,251,332 | 5/1966 | Vassar | 228/17.5 |
| 3,344,640 | 10/1967 | Zelnick et al. | 72/168 |

*Primary Examiner*—Nicholas P. Godici
*Assistant Examiner*—Carmine Cuda
*Attorney, Agent, or Firm*—Fleit, Jacobson, Cohn & Price

[57] ABSTRACT

In a method for making thin-walled metal pipes, application of a pre-deformation to a metal sheet by plastic bending longitudinally perpendicular thereto, and forming the metal sheet into a pipelike shape by use of the widthwise curvature resulting from residual stress of the metal sheet receiving such plastic bending, when its lengthwise curvature is reduced to zero, the metal sheet being joined together at its junction.

9 Claims, 2 Drawing Sheets

METHOD FOR MAKING THIN-WALLED METAL PIPES

FIELD OF THE INVENTION

The present invention relates to a method for manufacturing a metal pipe, having a small thickness (t) to outer diameter (D) ratio of up to 2%, from a metal sheet, making effective use of plastic pre-deformation by bending applied thereto.

DESCRIPTION OF THE PRIOR ART

The method of making metal pipes hitherto known in the art has generally been of the continuous production line type wherein metal sheets are successively bent in their widthwise directions into a pipelike shape with a forming machine comprising a number of calibrated forming rolls or cage rolls arranged in tandem. Each of the thus formed metal sheets is joined together on both sides by means of butt welding.

When it is intended to make a thin-walled metal pipe by such a method, however, a metal sheet does not receive plastic deformation sufficient to bend it to the radius of curvature (R=D/2) of the desired product, since the thickness t of the metal sheet is much smaller than the outer diameter D of the product pipe. Thus, since the elastic deformation of the metal sheet is increased during the bending process, a large amount of spring back occurs as the metal sheet leaves one roll and enters the next roll. For this reason, sufficient bending of the sheet edges may not occur, or large edge stretching may tend to bring about edge buckling in the sheet. To eliminate such problems, it has been proposed to increase the number of the rolls involved and thereby suppress the spring back as much as possible. Due to a narrow range allowed for size variations, however, such a proposal has had problems in that an extended period of time is required to change or adjust the rolls. Also, the duration of firm contact of the metal sheet with the rolls, in which the metal sheet is formed into a tubular shape, is extended, thus resulting in the occurrence of surface flaws.

SUMMARY OF THE INVENTION

A main object of the present invention is to solve the aforesaid problems existing in the prior art.

A broader aspect of the present invention comprises applying pre-deformation to a metal sheet by plastically bending the sheet in a direction longitudinally perpendicular thereto, and forming the metal sheet into a pipelike shape by use of a widthwise curvature resulting from residual stress of the metal sheet receiving such plastic bending (hereinafter referred to as widthwise curvature, when the lengthwise curvature of the sheet is reduced to zero.

More specifically, the present invention provides a method for making thin-walled metal pipes, characterized in that a metal sheet is subjected to plastic bending with a small-diameter bending roll longitudinally perpendicular with the face of the sheet, which turns inside to form the inside of the pipe. The lengthwise curvature of the metal sheet is reduced to zero, whereby the metal sheet is bent widthwise into a pipelike shape according to the curvature of the end product by use of its widthwise curvature. The metal sheet is then joined together at the junction.

BRIEF DESCRIPTION OF THE DRAWINGS

For a better understanding of the nature and objects of the present invention, reference should be made to the following detailed description considered in connection with the accompanying drawings, in which.

PREFERRED EMBODIMENTS OF THE INVENTION

Figure 1:
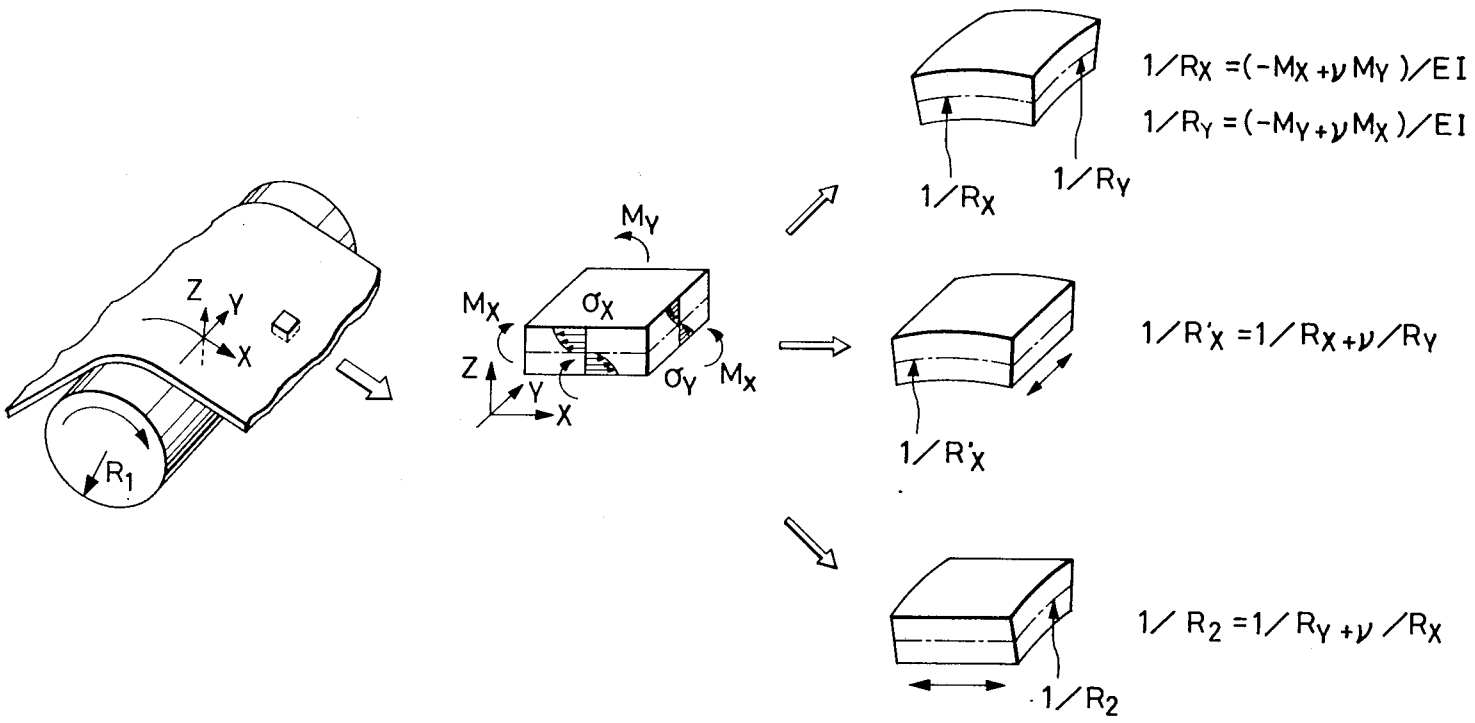
FIG. 1 is a view illustrating the principles of the method for making thin-walled metal pipes according to the present invention.

Referring to FIG. 1, the principles of the deformation according to the present invention are shown.

With a small-diameter bending roll disposed perpendicularly with respect to a metal sheet in its lengthwise direction X, plastic bending is first applied thereto to obtain a radius of curvature $R_1$. After the plastic bending has been carried out, the lengthwise (X) and widthwise (Y) curvatures of the metal sheet are reduced to zero; in other words, the metal sheet is kept in its flattened form, whereupon the inside portion of the metal sheet bent by the small-diameter bending roll is stretched in the lengthwise direction, and the outside portion is contracted in the lengthwise direction, so that stresses $\rho x$ and $\rho y$ occur in the X and Y directions. Bending moments Mx and My occur in the lengthwise (X) direction and widthwise (Y) direction, respectively. The metal sheet has been subjected to plastic bending, with the face to form the inside of the end pipe turning inside by means of the small-diameter bending roll disposed perpendicularly to the metal sheet in the lengthwise direction. The metal sheet is constrained only with respect to the lengthwise bending moment in such a manner that its lengthwise curvature alone is reduced to zero. The sheet then is formed into a pipelike shape having a curvature $1/R_2$ in the widthwise direction by bending moment My. If the metal sheet subjected to plastic bending and the small-diameter roll is of a length or width, or length plus width, sufficiently small to give rise to the so-called "saddle type" bowing, this curvature $1/R_2$ is expressed by the following equation:

$$1/R_2=(1/Ry)+\nu(1/Rx)$$

wherein (1/Rx) and (1/Ry) are respectively the lengthwise and widthwise curvatures of that metal sheet, when not constrained in both the lengthwise and widthwise directions, and $\nu$ is the Poisson's ratio. It is to be noted that in the equations of FIG. 1, EI is the flexural rigidity.

Thereupon, the metal sheet formed into a pipelike shape may be bent according to the curvature of the end product, and joined together at the junction to make a thin-walled metal pipe.

When the widthwise curvature $1/R_2$ of the metal sheet bent widthwise by the bending moment can only be plastically bent to a degree less than that of the end product, the curvature radius $R_1$ may be such that it is reduced as much as possible. The metal sheet may then be bent according to the curvature of the end product with squeeze rolls at the position at which the sheet is joined together at the junction. Alternatively, when the radius of curvature $R_1$ of the small-diameter bending roll is such that the widthwise curvature $1/R_2$ exceeds the curvature of the end product, a mandrel having the same curvature as that of the end product may be disposed on a portion of the pipe to define its inside at the stage at which the lengthwise curvature of the metal sheet is reduced to zero. The metal sheet is thereby bent widthwise into a pipelike shape by use of its widthwise curvature by the small-diameter bending roll. Still alternatively, when the width of the metal sheet subjected to plastic bending by the small-diameter bending roll is larger than the curvature of the end product by a factor of $4\pi$, it may be formed into double or multiple pipes.

In one aspect, the present method for making thin-walled metal pipes may be carried out in a continuous production line. A metal sheet with a face which defines the inside of the pipe is subjected to plastic bending with the small-diameter bending roll disposed lengthwise at a right angle thereto. The pipe immediately passes into the step of reducing the lengthwise curvature of the metal sheet to zero, thereby widthwise bending the sheet into a pipelike shape according to the curvature of the end product by use of its widthwise curvature. The thus formed metal sheet is joined together at its junction to make a thin-wall metal pipe. The present invention may also be carried out in separate lines. More specifically, the plastic-bent metal sheet can be cut perpendicularly with respect to its lengthwise direction, and coiled by the residual bending moment resulting from plastic bending by said small-diameter bending roll. When necessary, at a later stage, the coiled metal sheet can be uncoiled to reduce its lengthwise curvature to zero, whereby the metal sheet is bent widthwise into a pipelike shape according to the curvature of the end product by use of its widthwise curvature. The thus formed metal sheet is then joined together at the junction to make a thin-walled metal pipe.

Joining of the metal sheet formed into a pipelike shape at its junction may be achieved by welding, as is the case with conventional metal pipe-making methods, or by other means such as brazing, bonding or seam bending.

Figure 2:
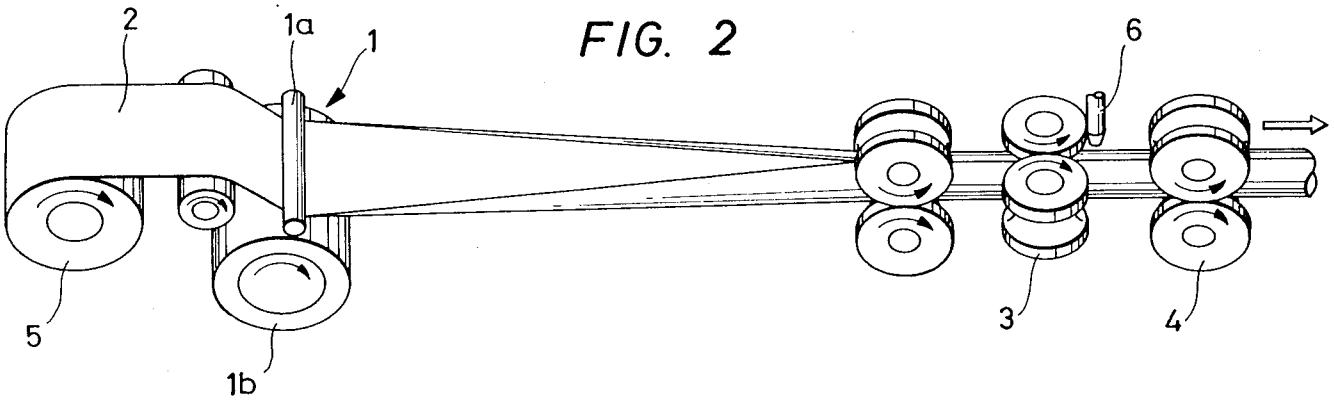
FIG. 2 is a perspective view illustrating the method and use for making thin-walled metal pipes according to the present invention in a continuous production line.
Figure 3:
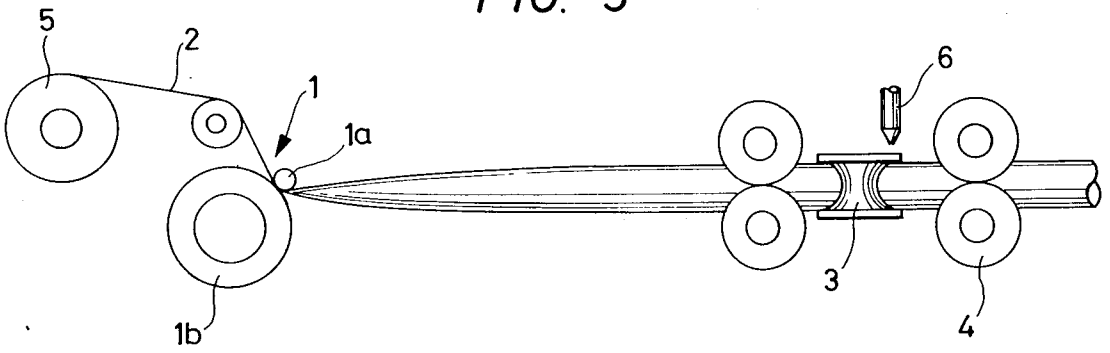
FIG. 3 is a side view of FIG. 2.

The method for making thin-walled metal pipes according to the present invention will now be explained with reference to the perspective and side views shown in FIGS. 2 and 3, respectively.

A pre-deforming device shown generally at 1 is provided first and comprises a small-diameter bending roll 1*a* and a polyurethane lining roll 1*b* to be pressed against it. The rolls 1*a* and 1*b* are disposed just after an uncoiler 5 located at the starting point of the continuous forming line. A metal sheet 2, preferably a stainless steel sheet, a high-tension steel plate or a titanium sheet, is subjected to plastic bending. The face which is to form the inside of the end pipe is turned inside by means of the small-diameter bending roll 1a located perpendicularly with respect to the metal sheet 2 in the lengthwise direction. Immediately after being passed through the pre-deforming device 1, the metal sheet 2 may be considered to be of a flattened shape.

When the widthwise curvature of $1/R_2$ occurring from the small-diameter bending roll 1*a* is equal to the curvature of the desired product, the metal sheet 2 takes on the shape of the end product, which as illustrated, is the pipelike shape at the positions of one or more sets of calibrated rolls or cage rolls, such as side rolls 3 and feed rolls 4. The positions of rolls 3 and 4 are spaced away from the pre-deforming device 1 by a distance about 30 times as large as the diameter of the end product, which defines an elastic limit range within which the side edges of the metal sheet 2 elongate lengthwise toward the end point of the production line. While the metal sheet 2 moves from the pre-deforming device 1 to the side rolls 3, its widthwise curvature undergoes successive deformation.

When the widthwise curvature of sheet 2 is sufficient, that is, when the widthwise curvature $1/R_2$ resulting from the small-diameter bending roll 1*a* is larger than that of the end product, a mandrel, around which the metal sheet is to be wound, may be provided at a position at which metal sheet 2 takes on the pipelike shape.

When the widthwise curvature of pre-deforming is insufficient, on the other hand, pipe-forming may be possible, if calibrated rolls or cage rolls are provided downstream of the continuous production line between the pre-forming device 1 and the side rolls 3 to compensate for the insufficient amount of forming. In some cases, forming the thin-walled metal pipes may be possible only with an arrangement wherein the pre-deforming device 1 is added to a conventional unit including a number of forming rolls.

Thus, if the metal sheet is formed into a tubular shape having the same curvature as that of the end product, it may then be joined together at a junction by means of welding with a welding torch 6 or other means such as brazing, bonding or seam bending. Portions of the metal sheet, if projecting from that junction, may be cut out or otherwise removed.

The foregoing describes the processes as being carried out in a continuous production line from plastically bending the metal sheet with the small-diameter bending roll to joining of the metal sheet at a junction. According to the present invention, however, it is possible to carry out, in separate lines, the process of plastically bending a metal sheet with the small-diameter bending roll and the process wherein the lengthwise curvature of the metal sheet is reduced to zero. The sheet is bent widthwise into a pipelike shape and to the curvature of the end pipe by use of its widthwise curvature. Joining of the metal sheet at the junction follows. In the latter case, if the metal sheet, which has been subjected to plastic bending by the small-diameter bending roll, is cut at right angles relative to its lengthwise direction, it is then automatically coiled by the residual moment in its lengthwise direction. Thus, when a thin-walled metal pipe is to be made, the coiled metal sheet is first uncoiled, and the lengthwise curvature thereof is reduced to zero. The sheet is bent widthwise into a pipelike shape according to the curvature of the end product by use of its widthwise curvature. Finally, the metal sheet may be joined together at the junction.

When the present method is to be carried out in a continuous production line, the distortion upon elongation of the side edges of the metal sheet can be kept within elastic limits by allowing the deformation region length to be about 30 times as large as the diameter of the end product, as described above, provided that the widthwise curvature thereof is equal to the curvature of the end product. Thus, edge buckling is prevented from occurring, and the number of the rolls required for forming is considerably reduced. Even when the widthwise curvature of the metal sheet is insufficient, the number of rolls required for forming is much fewer than would be the case if conventional roll forming was applied. In addition, even when the same number of rolls are used as in conventional roll forming, without omission of the conventional forming rolls, the amount of spring-back is reduced while the length of the forming region is increased, as compared with virgin sheets to which no pre-deformation is applied at all. Thus, edge stretching can be suppressed, with resulting increases in edge formability.

Further, when it is very likely that the thin-walled metal pipe to be made may buckle at its edges during forming or when the metal sheet is formed into a pipelike shape, the position wherein plastic bending occurs by the small-diameter roll should be shifted toward the extended centerline of the thin-walled metal pipe. By doing so, a difference between the length of the side edges of the metal sheet and the length of the metal sheet center line extending from the position of plastic bending occurring from the small-diameter bending roll to the position of bending according to the curvature of the end product is reduced. Buckling of the side edges of the metal sheet is thereby avoided. Thus, with the arrangement wherein the position of plastic bending occurring from the small-diameter bending roll is shifted from the line extending from the direction of movement of the finished thin-walled metal pipe toward the center direction thereof, satisfactory thin-walled pipes can be made. Also, a continuous production line which is reduced in length is provided, which decreases the size of the overall arrangement. Still further, when thin-walled metal pipes are made in such a continuous production line, it is preferred that a tension below the elastic limit be applied lengthwise to the metal sheet, which has been subjected to plastic bending by means of the small-diameter bending roll arranged lengthwise perpendicularly thereto, with the face forming the inside of the end pipe turning inside. The reasons for this are that, while the metal sheet subjected to plastic bending with the small-diameter bending roll is moved to the position at which it is formed into a pipelike shape, the side edges thereof are prevented from slackening and, hence, there is little or no difference in the length of the metal sheet, so that satisfactory thin-walled metal pipes can be made. However, a tension exceeding the elastic limit is not preferred, since the widthwise residual force added to the metal sheet by plastic bending with the small-diameter bending roll disappears, thus making it difficult to form the sheet into a pipelike shape.

EXAMPLES

EXAMPLE 1

For plastic bending, an SUS 304 metal sheet, with a face which was to define the inside of the end pipe, was provided. The sheet was 0.1 mm in thickness and 89.5 mm in width and had a 0.2% proof strength of 160 kgf/mm$^2$. The sheet was pressed between a small-diameter bending roll located lengthwise perpendicularly to the sheet and having a diameter of 3 mm and a polyurethane lining roll of 100 mm in diameter and 100 mm in width under a press load of 300 kgf. The lengthwise curvature of the metal sheet was then reduced to zero at a position spaced away 950 mm from the position of the small-diameter bending roll. The sheet was bent widthwise by use of the widthwise curvature, and was pressed between squeeze rolls into a pipelike shape of 28.6 mm in diameter. Finally, the thus formed metal sheet was joined together on its side edges by means of microplasma welding to make a thin-walled metal pipe, which was found to suffer from no edge buckling and to have satisfactory roundness.

EXAMPLE 2

For plastic bending, an SUS 304 metal sheet, with a face which was to define the inside of the end pipe turning inside, was provided. The sheet was 0.15 mm in thickness and 89.4 mm in width and had a 0.2% proof strength of 125 kgf/mm$^2$. The sheet was pressed between a small-diameter bending roll located lengthwise perpendicularly to the sheet and having a diameter of 3 mm and a polyurethane lining roll of 100 mm in diameter and 100 mm in width under a press load of 400 kgf. Upon reaching a length of 5 m, the metal sheet was cut perpendicularly with respect to its lengthwise direction to obtain a coiled sheet. Thereafter, the coiled sheet was uncoiled, and the lengthwise curvature thereof was reduced to zero. The sheet was thereby bent widthwise by use of the widthwise curvature. However, since the metal sheet only took on an arcuate form of 46 mm in diameter, it was pressed at both its ends and its central portion between calibrated rolls into a pipelike shape of 28.6 mm in diameter. Finally, the thus formed metal sheet was joined together on its side edges by means of microplasma welding to make a thin-walled metal pipe, which was found to suffer from no edge buckling and have satisfactory roundness.

EXAMPLE 3

For plastic bending, a metal sheet, with a face which was to define the inside of the end pipe turning inside, was provided. The sheet was 0.2 mm in thickness and 89.2 mm in width, had a 0.2% proof strength of 55 kgf/mm$^2$ and consisted of a titanium sheet. The sheet was pressed between a small-diameter bending roll located lengthwise perpendicularly to the sheet and having a diameter of 3 mm and a polyurethane lining roll of 100 mm in diameter and 100 mm in width under a press load of 400 kgf. The lengthwise curvature of the metal sheet was then reduced to zero at a position spaced away 950 mm from the position of the small-diameter bending roll, whereby it was widthwise bent by use of the widthwise curvature, and was pressed between squeeze rolls into a pipelike shape of 28.6 mm in diameter. In this example, the metal sheet was joined together on its side edges by means of microplasma welding at the position of the squeeze rolls such that the position of plastic bending with the small-diameter bending roll was found 30 mm close to the central direction of the metal pipe from the line extending from the direction of movement of the bottom of the metal pipe from the squeeze rolls, thereby making a thin-walled metal pipe which did not suffer from any edge buckling at all. The pipe also had extremely good roundness.

The present method for fabricating thin-walled metal pipes, making use of pre-deformation as detailed above renders possible the making of thin-walled metal pipes from high-strength metal sheets, which has heretofore been considered difficult, and makes it possible to easily manufacture thin-walled metal pipes even from unannealed materials. According to the present method, reductions in the number of the rolls involved are expected with corresponding cut-downs in the production cost. Further, uniform widthwise bending gives satisfactory curvature distribution, and a reduced number of the rolls presents a reduced chance of surface flaws. Thus, the present method for making thin-walled metal pipes is of industrial value.

What is claimed is:

1. A method for making thin-walled metal pipes, comprising the steps of:

subjecting a metal sheet to lengthwise plastic bending by means of a small-diameter bending roll with an axis disposed perpendicularly thereto, a face of said metal sheet which is to define the inside of the metal pipe turning inward, causing said metal sheet to bend itself widthwise into a pipelike shape by use of widthwise curvature resulting from residual stress of the metal sheet after receiving such plastic bending by reducing the lengthwise curvature of the metal sheet to zero, and joining longitudinal edges of said metal sheet together.

2. A method as recited in claim 1, wherein the curvature of the end product is defined by the widthwise curvature of said metal sheet at a position that is spaced away from the position of said plastic bending by means of the small-diameter bending roll by a distance about 30 times as large as the diameter of the end product.

3. A method as recited in claim 1, wherein said plastic bending by means of the small-diameter bending roll, and the widthwise bending of said metal sheet into a pipelike shape according to the curvature of the end product by use of the widthwise curvature resulting from said residual stress of the metal sheet receiving such plastic bending by reducing the lengthwise curvature of the metal sheet to zero followed by joining of said metal sheet at the junction, are respectively carried out in separate lines.

4. A method as recited in claim 1, wherein said joining longitudinal edges of the metal sheet formed into a pipelike shape at the junction is carried out by welding.

5. A method as recited in claim 1, wherein said joining longitudinal edges of the metal sheet formed into a pipelike shape at the junction is carried out by seam bending.

6. A method as recited in claim 1, wherein said joining longitudinal edges of the metal sheet formed into a pipelike shape at the junction is carried out by brazing.

7. A method as recited in claim 1, wherein said joining longitudinal edges of the metal sheet formed into a pipelike shape at the junction is carried out by bonding.

8. A method as recited in claim 1, wherein the processes from said plastic bending by means of the small-diameter bending roll to said joining are carried out in a continuous line.

9. A method as recited in claim 8, wherein the position of said plastic bending by means of the small-diameter bending roll is located from the line extending from the direction of movement of the bottom of the thin-walled metal pipe, formed into a pipelike shape, joined together and moved, toward the center direction thereof.

* * * * *